United States Patent [19]

Brown, Sr.

[11] Patent Number: 4,574,402

[45] Date of Patent: Mar. 11, 1986

[54] TWO PIECE CLOSET RING WITH MOISTURE MEMBRANE CLAMPING ARRANGEMENT

[76] Inventor: Theodore C. Brown, Sr., 601 Beaver Dam Rd., Raleigh, N.C. 27606

[21] Appl. No.: 696,914

[22] Filed: Jan. 31, 1985

Related U.S. Application Data

[63] Continuation-in-part of Ser. No. 380,554, May 21, 1982, Pat. No. 4,502,166.

[51] Int. Cl.[4] ..... E03C 11/00

[52] U.S. Cl. ..... 4/252 R; 285/56

[58] Field of Search ..... 4/252 R, DIG. 7; 285/56, 59; 277/117, 118, 124, 205, 105, 106

[56] References Cited

U.S. PATENT DOCUMENTS

| | | | |
|---|---|---|---|
| 3,419,288 | 12/1968 | Logsdon | 4/252 R |
| 3,579,670 | 7/1968 | Frank | 4/252 R |
| 3,896,510 | 7/1975 | O'Connell | 4/252 R |
| 4,306,738 | 12/1981 | Lindquist | 285/56 |
| 4,470,162 | 9/1984 | Marshall | 4/252 R |
| 4,482,161 | 11/1984 | Izzi, Sr. | 4/252 R |
| 4,502,166 | 3/1985 | Brown, Sr. | 4/252 R |

*Primary Examiner*—Stephen Marcus
*Assistant Examiner*—Leo J. Peters
*Attorney, Agent, or Firm*—Mills and Coats

[57] ABSTRACT

This invention is an improved sealing arrangement for use in conjunction with water closet rings wherein a lower section includes an inwardly beveled shoulder which fits a similar configured neoprene type gasket. When a specifically designed top section telescopically engages the interior of the lower section, the gasket is expanded to form a water tight seal about the drain pipe or other member associated therewith. Also provided is a clamping arrangement for a moisture impervious membrane.

7 Claims, 5 Drawing Figures

TWO PIECE CLOSET RING WITH MOISTURE MEMBRANE CLAMPING ARRANGEMENT

This is a continuation-in-part of U.S. patent application Ser. No. 06/380,554, filed May 21, 1982, entitled "TWO PIECE CLOSET RING" now U.S. Pat. No. 4,502,166.

FIELD OF INVENTION

This invention relates to plumbing fixtures and more particularly to improved sealing means for use in conjunction with water closet rings.

BACKGROUND OF INVENTION

Water closets and their associated water closet rings have, of course, been in use for many years and secure the water closet to its associated drain pipe. The time accepted procedure using cast iron pipes has been to place the closet ring about the pipe so that it rests on the floor of the room and then fill in the tapered area between such pipe and such ring with lead and oakum to seal the two together.

With the advent of plastic drain pipe, lead and oakum could no longer be used because when heated to a liquid state, it would melt the pipe adjacent the ring.

Various arrangements have been experimented with to meet changing product requirements including the use of sealants other than lead and oakum. None of these substitute sealing means between water closet ring and drain pipe until now have been as satisfactory as lead and oakum in conjunction with cast iron pipe.

BRIEF DESCRIPTION OF INVENTION

After much research and study into the above-mentioned problems, the present invention has been developed to provide an improved gasket means for water closet rings which can be used equally well with cast iron pipe and plastic or PVC pipe. No heating or pouring is required to affect the seal between the ring and the pipe and the seal itself should remain effective throughout the useful life of the system.

The above is accomplished through the provision of a bottom section having a beveled, interiorly projecting shoulder which is adapted to juxtaposingly receive a gasket composed of a plyable material. A top or upper section is then placed on the upper edge of the gasket and once the pipe has been properly positioned, drawn down means are used to squeeze the gasket between the top and bottomsections to cause the same to expand against the pipe creating a water impervious seal between said ring and said pipe. The bottom section also includes an outwardly extending flange which, through use of a clamping ring, secures a moisture impervious membrane thereto.

In view of the above, it is an object of the present invention to provide, in combination, a two piece closet ring in combination with an improved gasket for effecting a water tight seal between such ring and its associated drain pipe and a means for securing a moisture impevious membrane thereto.

Another object of the present invention is to provide a sealing means including a first portion having an interiorly beveled shoulder adapted to receive a gasket means and a second portion adapted to be telescopically inserted into said first portion whereby said gasket can be caused to form a seal with an adjacent inserted structure and an outwardly extending flange and associated clamping ring to secure a moisture impervious membrane thereto to prevent moisture from passing thereby.

Another object of the present invention is to provide a neoprene type gasket used in conjunction with a two piece closet ring for effectuating a moisture impervious seal between such ring and its associated drain pipe.

Another object of the present invention is to provide, in a water closet ring, a beveled shoulder against which a neoprene type gasket is pressed to effectuate a moisture impervious seal against an adjoining pipe type means.

Another object of the present invention is to provide a two piece closet ring using corrosion resistant bolts to draw the parts together against a neoprene type gasket to effectuate a seal with an adjoining pipe.

Other objects and advantages of the present invention will become apparent and obvious from a study of the following description and the accompanying drawings which are merely illustrative of such invention.

DETAILED DESCRIPTION OF THE INVENTION

With further reference to the drawings, the two piece closet ring of the present invention, indicated generally at 10, includes a top section indicated generally at 11 and a bottom section indicated generally at 12.

Figure 1:
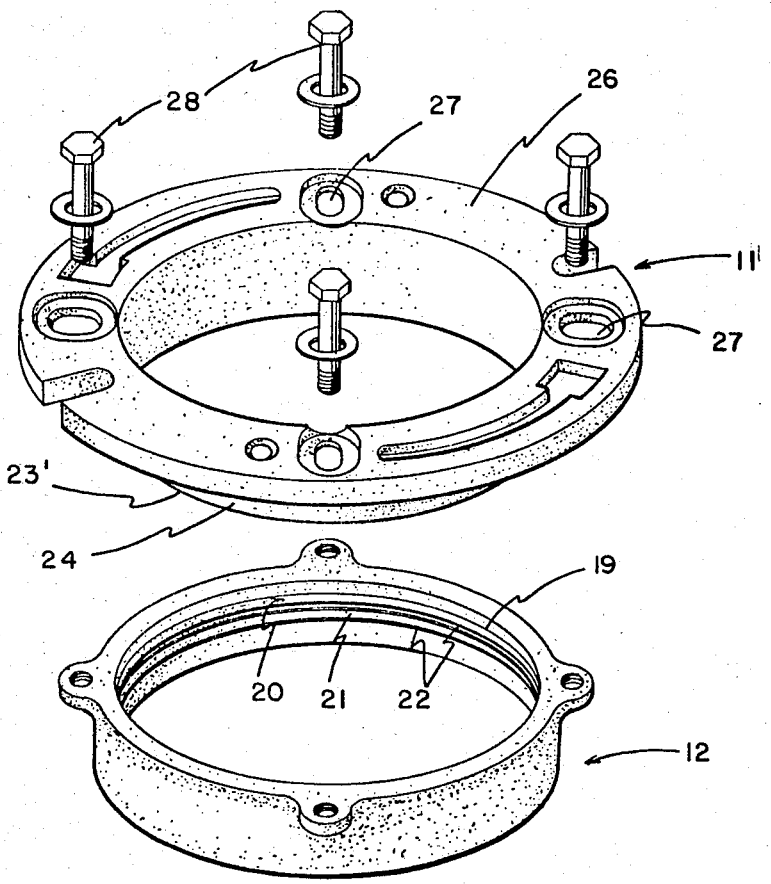
FIG. 1 is an exploded perspective view of the improved water closet ring of the present invention.
Figure 2:
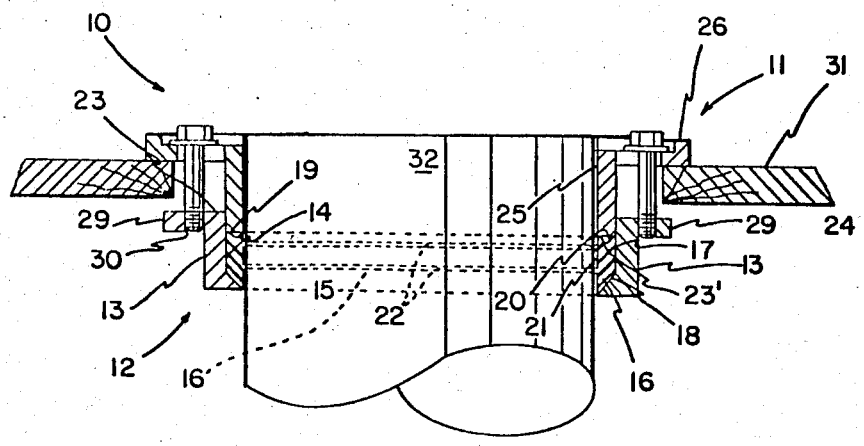
FIG. 2 is a sectional view showing the relationship of the improved closet ring and its associated gasket with a typical drain pipe.
Figure 3:
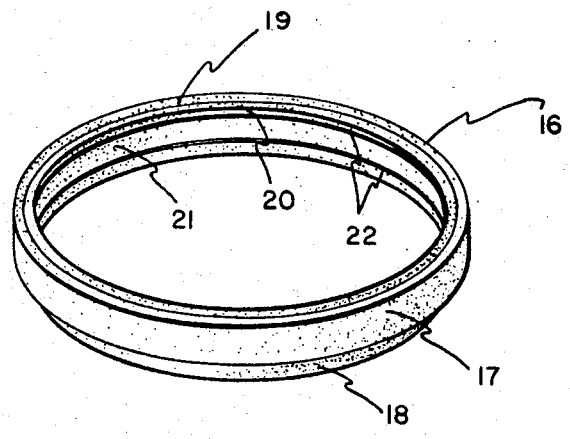
FIG. 3 is a perspective view of the improved gasket means used and associated with the water closet ring.

The bottom section 12 is formed in a generally ring-like configuration having an exterior 13 and an interior 14. The lower portion of the interior 14 includes a beveled, interiorly projecting shoulder 15 as can clearly be seen in FIG. 2.

A resilient, plyable gasket 16 composed of neoprene or similar material is provided. This gasket is ring-like in configuration and includes an exterior surface 17 and an adjoining beveled surface 18. This gasket 16 also includes an upper end surface 19 having a centrally disposed groove 20 formed therein. Finally the interior surface 21 of gasket 16 includes at least two inwardly projecting sealing ribs 22.

The top section 11 includes a ring portion 23 having an exterior surface 24 and an interior surface 25. To the upper edge of ring portion 23, as disposed in the drawings, is provided an outwardly disposed closet flange 26. This closet flange includes a plurality of smooth bore openings 27 therein which are adapted to receive pull down means such as bolts 28 formed from stainless steel or other suitable corrosive resistant material.

A plurality of bolt tabs 29 are provided on the exterior 13 of bottom section 12. Each of these tabs has a threaded opening 30 therein to receive bolts 28.

Figure 4:
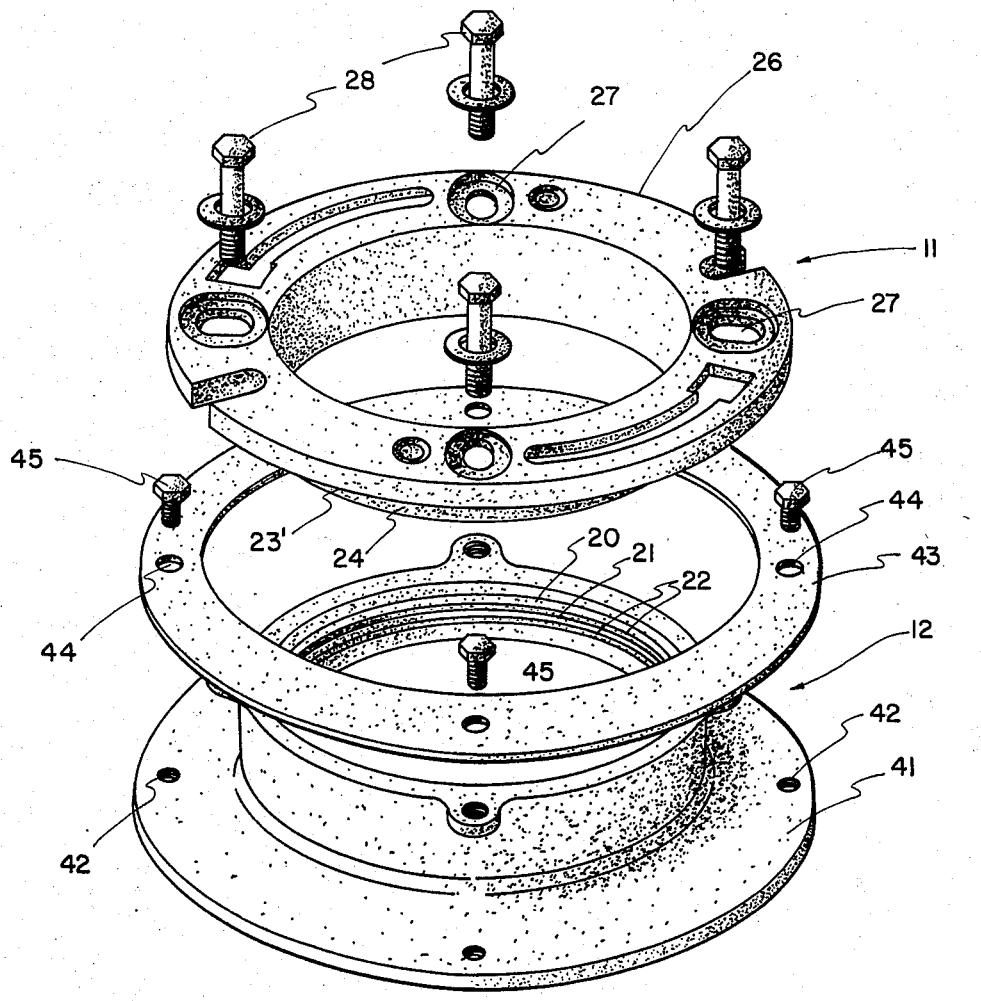
FIG. 4 is an exploded perspective view of the improved water closet ring with moisture membrane clamping means.
Figure 5:
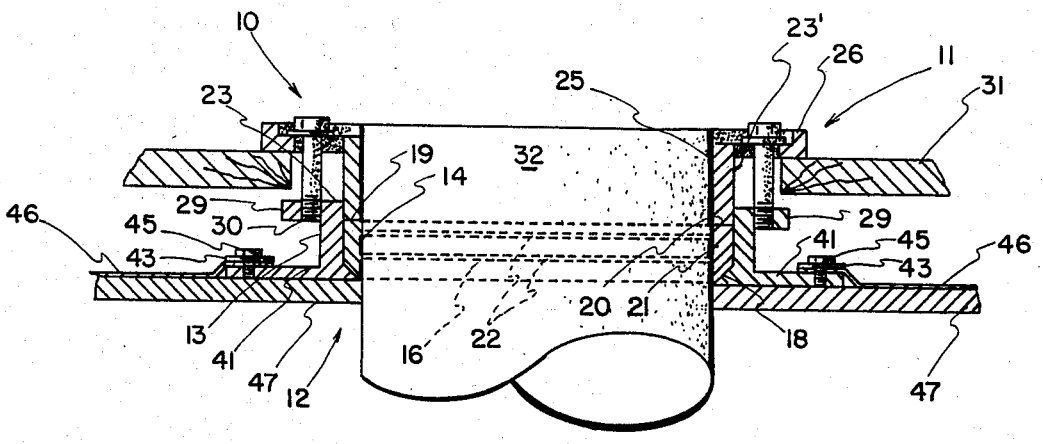
FIG. 5 is a sectional view showing the relationship of the improved closet ring and its associated gasket with a typical drain pipe and the moisture membrane clamping means.

In the modification shown in FIGS. 4 and 5, outwardly extending from the lower portion of the bottom section 12 is a clamping flange 41. A plurality of threaded openings 42 are provided in said flange.

A generally flat clamping ring 43 is provided and includes openings 44 passing therethrough. Each of the openings 44 is preferably smooth bore and of slightly larger diameter than threaded openings 42.

Threaded bolts 45 are adapted to pass through smooth openings 44 of clamping ring 43 and be threaded into openings 42 of clamping flange 41.

To use the closet ring of the present invention, an opening is provided in floor 31 having a diameter less than the diameter of closet flange 26 but greater than the greatest distance between opposed bolt tabs on the bottom section 12.

A drain pipe 32 is centrally disposed in the opening in floor 31 and projects above the plane thereof.

Next the gasket 16 is inserted into the bottom section 12 so that its exterior surface 17 lies juxtaposed to interior surface 14 and such gasket's beveled surface 18 lies juxtaposed to beveled shoulder 15.

Top section 11 is telescopically inserted into the interior of bottom section 12 until lower surface 23' rests against the upper surface 19 of gasket 16. Bolts 28 are then passed through openings 27 of top section 11 and threaded into openings 30 of tabs 29 of bottom section 12 until barely snug.

The now assembled two piece closet ring 10 is next slipped over pipe 32 until the bottom of flange 26 engages the upper surface of floor 31 and rests thereon. Bolts 28 are then tightened down thereby pushing gasket 16 downwardly against beveled surface 15 which forces such gasket inwardly against pipe 32. Sealing ribs 22 compress more readily than the remaining portions of gasket 16 and, therefore, will conform to any surface irregularities in pipe 32 thereby insuring a moisture proof seal between the top section 11, the bottom section 12, and the drain pipe 32.

Once the closet ring 10 has been installed as described above, a water-proof membrane 46 is laid out below floor 31 and above ceiling 47 in such a manner that it overlaps clamping flange 41. Next clamping ring 43 is placed over clamping flange 41 with the openings of the flange and the ring in alignment. Bolts 45 are then passed through clamping ring 43, the water-proof membrane 21, and are threaded into openings 42 of flange 41. As the various bolts 45 are tightened down, a water-proof seal between the closet ring 43 and the water impervious membrane 41 is formed.

Next the membrane 46 is spread out above ceiling 47 in all directions.

Since a water impervious seal is formed between drain pipe 32 and the two piece closet ring 10 and also between clamping flange 41 by clamping ring 43 and water-proof membrane 46, any overflow water on floor 31 has no place to go and when discovered can be cleaned up without seepage causing water damage to the ceiling 47 and the rooms therebelow.

Although ceiling 47 is indicated as having membrane 46 disposed thereabove, it is anticipated that in certain applications the membrane 46 can be spread out over a sub-floor (not shown). If the membrane is turned up at the edges of the room and a lightweight aggregate poured thereover in the normal manner of such building processes, a water-tight structure can be formed.

From the above it can be seen that the present invention provides a relatively inexpensive and yet highly efficient means for sealing a closet ring to its associated drain pipe regardless of the type of material from which such ring or such pipe are formed. The present invention is simple to assemble and install while at the same time insuring a moisture impervious seal.

The terms "upper", "lower", "top", "bottom", and so forth have been used herein merely for convenience to describe the two piece closet ring and its parts as oriented in the drawings. It is to be understood, however, that these terms are in no way limiting to the invention since the ring may obviously be disposed in different orientations when in use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claims are intended to be embraced therein.

I claim:

1. An improved closet ring for use in conjunction with a pipe-type means comprising: a first section including a ring-like portion having a generally flat lower surface and an outwardly projecting closet flange disposed adjacent to a floor; a second section including a ring-like portion so sized as to telescopically receive at least a portion of said ring-like portion of said first section, said ring-like portion of said second section including a beveled, flat-in-cross-section, interiorly projecting shoulder coming to a point at its lower extremity; said pipe type means disposed adjacent to and interiorly of said telescoped first and second sections; a gasket means formed from a neoprene type resilient material and having a generally flat upper surface with a groove-like depression formed therein, said upper surface of said gasket being disposed generally juxtaposed to said flat lower surface of said first section, said gasket having at least two inwardly projecting sealing ribs lying juxtaposed to a portion of said pipe means, has an exterior lying juxtaposed to at least a portion of the interior of said ring portion of said second section, and has a lower, flat-in-cross-section, beveled portion coming to a point at its lower extremity lying juxtaposed to said flat beveled shoulder of said second section; means for creating telescopic pressure between said first and said second sections whereby said gasket will be force by said flat surface and said beveled shoulder into sealing contact with said pipe disposed interiorly of said section; and a clamping flange outwardly projecting from the lower portion of said second section, said clamping flange being disposed adjacent a horizontal surface beneath said floor; a clamping ring; means for securing said clamping ring juxtaposed to one side of said clamping flange; and a waterproof membrane clamped between said clamping ring and said clamping flange whereby a waterproof lining is formed between said floor and said horizontal surface

2. The closet ring of claim 1 wherein said means for creating telescopic pressure between said first and said second sections are a plurality of bolts.

3. The closet ring of claim 1 wherein said means for securing said clamping ring juxtaposed to one side of said clamping flange are a plurality of bolts.

4. The closet ring of claim 1 wherein said first and second sections are formed from cast iron.

5. The closet ring of claim 4 wherein said pipe is formed from a plastic type material.

6. The closet ring of claim 1 wherein said first and second sections and said pipe are all constructed of a similar type of material.

7. A closet ring as claimed in claim 1 wherein said first section includes a closet flange at its upper end for securement to a supporting floor surface and for securably receiving a water closet, said closet flange having bolt openings for receiving bolts which extend downwardly adjacent the outer periphery of said ring-like portion of said first section, said second section extending telescopically about the outer periphery of the ring-like portion of said first section and including threaded openings for receiving the threaded ends of said bolts, whereby tightening of said bolts moves said second sections upwardly toward said closet flange and effects said telescopic pressure, the arrangement being such that most of the rigid structure immediately adjacent the pipe is fixed structure of said first section, and the major movable structure of said second section is disposed outwardly of the pipe and separated therefrom by the ring-like portion of said first section and by said resilient gasket means.

* * * * *